US009304441B2

(12) United States Patent
Matsushita et al.

(10) Patent No.: US 9,304,441 B2
(45) Date of Patent: Apr. 5, 2016

(54) DEVELOPER ACCOMMODATING CONTAINER, DEVELOPER ACCOMMODATING UNIT, PROCESS CARTRIDGE AND IMAGE FORMING APPARATUS

(71) Applicant: CANON KABUSHIKI KAISHA, Tokyo (JP)

(72) Inventors: Masaaki Matsushita, Yokohama (JP); Koji Yamaguchi, Numazu (JP); Junichi Matsumura, Numazu (JP); Masatomi Yoshida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/018,485

(22) Filed: Sep. 5, 2013

(65) Prior Publication Data

US 2014/0072331 A1 Mar. 13, 2014

(30) Foreign Application Priority Data

Sep. 10, 2012 (JP) ..... 2012-198056
Aug. 2, 2013 (JP) ..... 2013-160961

(51) Int. Cl.
*G03G 15/08* (2006.01)

(52) U.S. Cl.
CPC ..... *G03G 15/0882* (2013.01); *G03G 15/0881* (2013.01); *G03G 15/0884* (2013.01); *G03G 15/0874* (2013.01)

(58) Field of Classification Search
CPC ..... G03G 15/0841; G03G 15/0881; G03G 15/0882; G03G 2215/0687
USPC ..... 399/102, 103, 105, 106
See application file for complete search history.

(56) References Cited

U.S. PATENT DOCUMENTS

| | | | | |
|---|---|---|---|---|
| 5,030,998 | A * | 7/1991 | Shibata et al. | 399/106 |
| 5,177,540 | A * | 1/1993 | Honda et al. | 399/106 |
| 6,097,907 | A * | 8/2000 | Fujiwara | 399/106 |
| 6,128,462 | A | 10/2000 | Kato et al. | |
| 6,157,796 | A * | 12/2000 | Fujiwara | 399/106 |
| 6,169,869 | B1 | 1/2001 | Inami et al. | |
| 6,175,703 | B1 | 1/2001 | Nakazono et al. | |

(Continued)

FOREIGN PATENT DOCUMENTS

| | | |
|---|---|---|
| CN | 1182894 A | 5/1998 |
| JP | 4-66980 A | 3/1992 |
| JP | 7-209976 A | 8/1995 |

OTHER PUBLICATIONS

Office Action in Chinese Patent Application No. 201310398762.7, dated Oct. 9, 2015 (with English translation).

*Primary Examiner* — Benjamin Schmitt
(74) *Attorney, Agent, or Firm* — Fitzpatrick, Cella, Harper & Scinto

(57) ABSTRACT

A developer accommodating container for accommodating a developer includes; an opening for permitting discharge of the developer; and a sealing member, mounted on the developer accommodating container, capable of exposing the opening by being moved. At least a part of the sealing member is formed of a material having compatibility with a material for forming the developer accommodating container and a material having incompatibility with the materiel for forming the developer accommodating container. Either one of the material having the compatibility and the material having the incompatibility is dispersed in the other one of the materials.

48 Claims, 13 Drawing Sheets

(56) References Cited

U.S. PATENT DOCUMENTS

| | | | | |
|---|---|---|---|---|
| 6,334,035 | B1 * | 12/2001 | Abe et al. | 399/106 |
| 6,337,964 | B2 | 1/2002 | Inami et al. | |
| 6,539,190 | B2 | 3/2003 | Oba et al. | |
| 6,681,088 | B2 | 1/2004 | Kanno et al. | |
| 6,782,219 | B2 | 8/2004 | Yoshino et al. | |
| 6,834,173 | B2 | 12/2004 | Yamaguchi et al. | |
| 6,898,401 | B2 | 5/2005 | Okano et al. | |
| 6,915,092 | B2 | 7/2005 | Yamaguchi et al. | |
| 6,947,687 | B2 | 9/2005 | Yamaguchi et al. | |
| 6,961,528 | B2 | 11/2005 | Yamaguchi et al. | |
| 6,963,706 | B2 | 11/2005 | Morioka et al. | |
| 6,983,115 | B2 | 1/2006 | Isobe et al. | |
| 7,068,965 | B2 | 6/2006 | Yoshino et al. | |
| 7,116,925 | B2 | 10/2006 | Yamaguchi | |
| 7,136,604 | B2 | 11/2006 | Chadani et al. | |
| 7,184,687 | B2 | 2/2007 | Yamaguchi et al. | |
| 7,194,225 | B2 | 3/2007 | Yamaguchi | |
| 7,319,834 | B2 | 1/2008 | Yamaguchi | |
| 7,398,040 | B2 | 7/2008 | Yoshida | |
| 7,477,865 | B2 | 1/2009 | Yamaguchi | |
| 7,519,310 | B2 | 4/2009 | Yamaguchi et al. | |
| 7,792,460 | B2 | 9/2010 | Yamaguchi et al. | |
| 8,121,519 | B2 | 2/2012 | Yamaguchi et al. | |
| 8,577,252 | B2 | 11/2013 | Anan et al. | |
| 2011/0170906 | A1 * | 7/2011 | Matsushita et al. | 399/114 |
| 2012/0027457 | A1 | 2/2012 | Yamaguchi et al. | |
| 2013/0136489 | A1 | 5/2013 | Yamaguchi et al. | |
| 2013/0164039 | A1 | 6/2013 | Matsushita et al. | |
| 2013/0164040 | A1 | 6/2013 | Matsushita et al. | |
| 2013/0336679 | A1 | 12/2013 | Furutani et al. | |
| 2013/0343785 | A1 | 12/2013 | Matsuzaki et al. | |
| 2014/0016961 | A1 | 1/2014 | Yasui et al. | |
| 2014/0029974 | A1 | 1/2014 | Uesugi et al. | |

* cited by examiner

DEVELOPER ACCOMMODATING CONTAINER, DEVELOPER ACCOMMODATING UNIT, PROCESS CARTRIDGE AND IMAGE FORMING APPARATUS

FIELD OF THE INVENTION AND RELATED ART

The present invention relates to a developer accommodating container for accommodating a developer, a developer accommodating unit including the developer accommodating container, a process cartridge including the developer accommodating container and an electrophotographic image forming apparatus including these members.

Here, the image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine and the like. The process cartridge refers to a cartridge which is prepared by integrally constituting the developer accommodating container accommodating the developer or the developer accommodating unit accommodating the developer with at least a photosensitive member, and which is made detachably mountable to an image forming apparatus main assembly.

Further, the developer accommodating container and the developer accommodating unit are accommodated in the image forming apparatus or the process cartridge.

In a conventional electrophotographic image forming apparatus using an electrophotographic image forming process, a process cartridge type in which an electrophotographic photosensitive member and a process means actable on the photosensitive member are integrally assembled into a cartridge and the cartridge is made detachably mount able to an electrophotographic image forming apparatus main assembly has been employed.

In such a process cartridge, an opening (portion) provided to a developer accommodating frame for accommodating a developer (toner, carrier and the like) is sealed with a sheet-like sealing member. Further, during use, a bonding portion of the sealing member is peeled off to unseal the opening to permit supply of the developer. Such a type has been widely employed (Japanese Laid-Open Patent Application (JP-A) Hei 4-66980). Here, in order to reduce a load when the sealing member is peeled of, a constitution in which a free end of the sealing member is folded back and the sealing member is capable of being pulled in a direction opposite from a folded-back portion has been widely employed.

Further, a constitution in which a bonding pattern is devised in order to alleviate a force for pulling the sheet-like sealing member, thereby to improve an unsealing operation property has been disclosed in JP-A Hei 7-209976. In this constitution, strength when the sealing member having a wide opening width is pulled to unseal the opening is alleviated by forming a leading edge portion and a trailing edge portion of the sealing member with respect to a pulling-out direction en a chevron shape and by making a width of each of the leading edge portion and the trailing edge portion narrower than a width of a middle portion.

However, the above-described conventional examples (constitutions) were accompanied with the following problems.

In JP-A Hei 4-66980, for the purpose of improving operativity of supply of the developer and of preventing scattering of the developer in the apparatus, a method in which the opening of the container is closed to accommodate the developer is described. However, JP-A Hei 4-66980 is orient about a constitution for improving the unsealing operation property when the sealing member is peeled off.

Further, in JP-A Hei 7-203976, the chevron-shaped portions with respect to the pulling-out direction of the sealing member are provided, s that a peeling force is reduced to some extent to improve the unsealing operation property. However, in order to further reduce the peeling force, an apex angle of the chevron-shaped portion is required to be made an acute angle of less than 90 degrees, so that the chevron-shaped portion becomes large. Correspondingly thereto, a space for permitting sealing of the sheet-like sealing member is needed, and therefore the developer accommodating unit is increased in size.

SUMMARY OF THE INVENTION

The present invention is a further development of the above-described conventional constitutions. A principal object of the present invention is to stably improving compatibility between a sealing property of a sealing member and an unsealing property of an unsealing members.

According to an aspect of the present invention, there is provided a developer accommodating container for accommodating a developer, comprising: an opening for permitting discharge, of the developer; and a sealing member, mounted on the developer accommodating container, capable of exposing the opening by being moves, wherein at least a part of the sealing member is formed of a material having compatibility with a material for forming the developer accommodating container and a material having incompatibility with the material for forming the developer accommodating container, and wherein either one of the material having the compatibility and the material having the incompatibility is dispersed in the other one of the materials.

These and other objects, features and advantages of the present invention will become more apparent upon a consideration of the following description of the preferred embodiments of the present invention taken in conjunction with the accompanying drawings.

Figure 3:
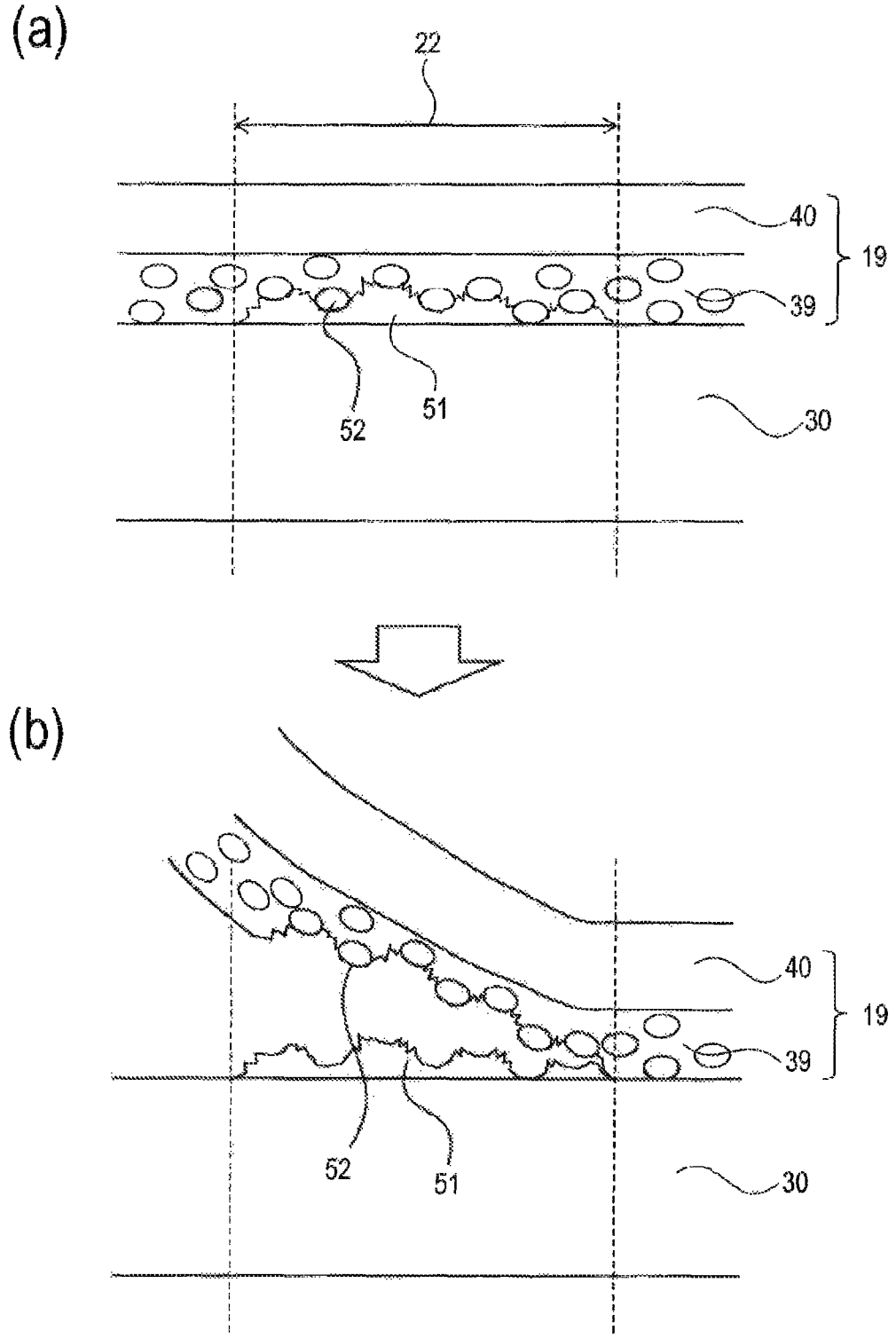

Parts (a) and (b) of FIG. 3 are principal sectional views of a sealing member in Embodiment 1 of the present invention.

Figure 1:
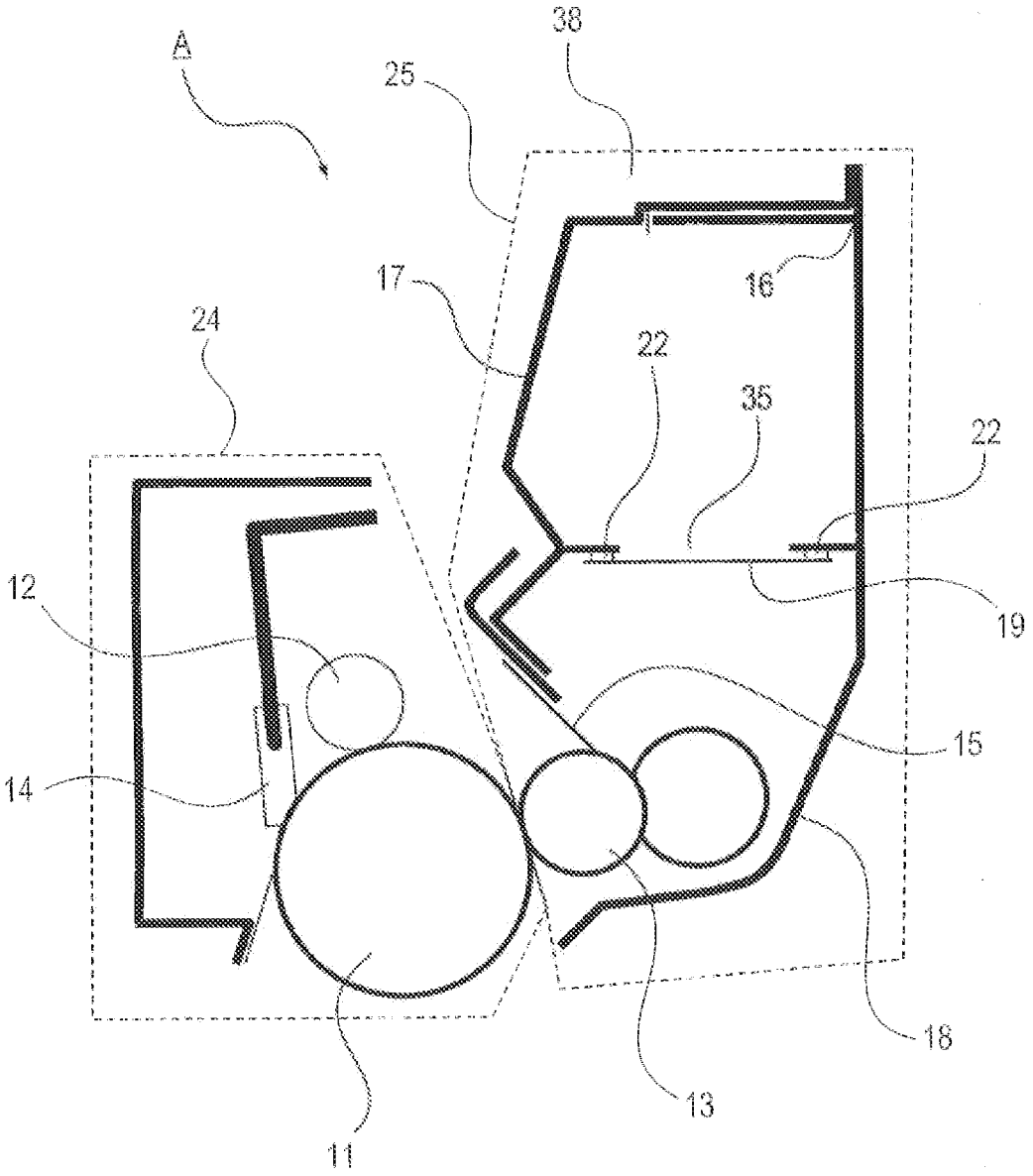
FIG. 1 is a principal sectional view of a process cartridge detachably mountable to an image forming apparatus main assembly.

Parts (a) and (b) of FIG. 1 are principal sectional views of a sealing member in a comparison example.

Figure 5:
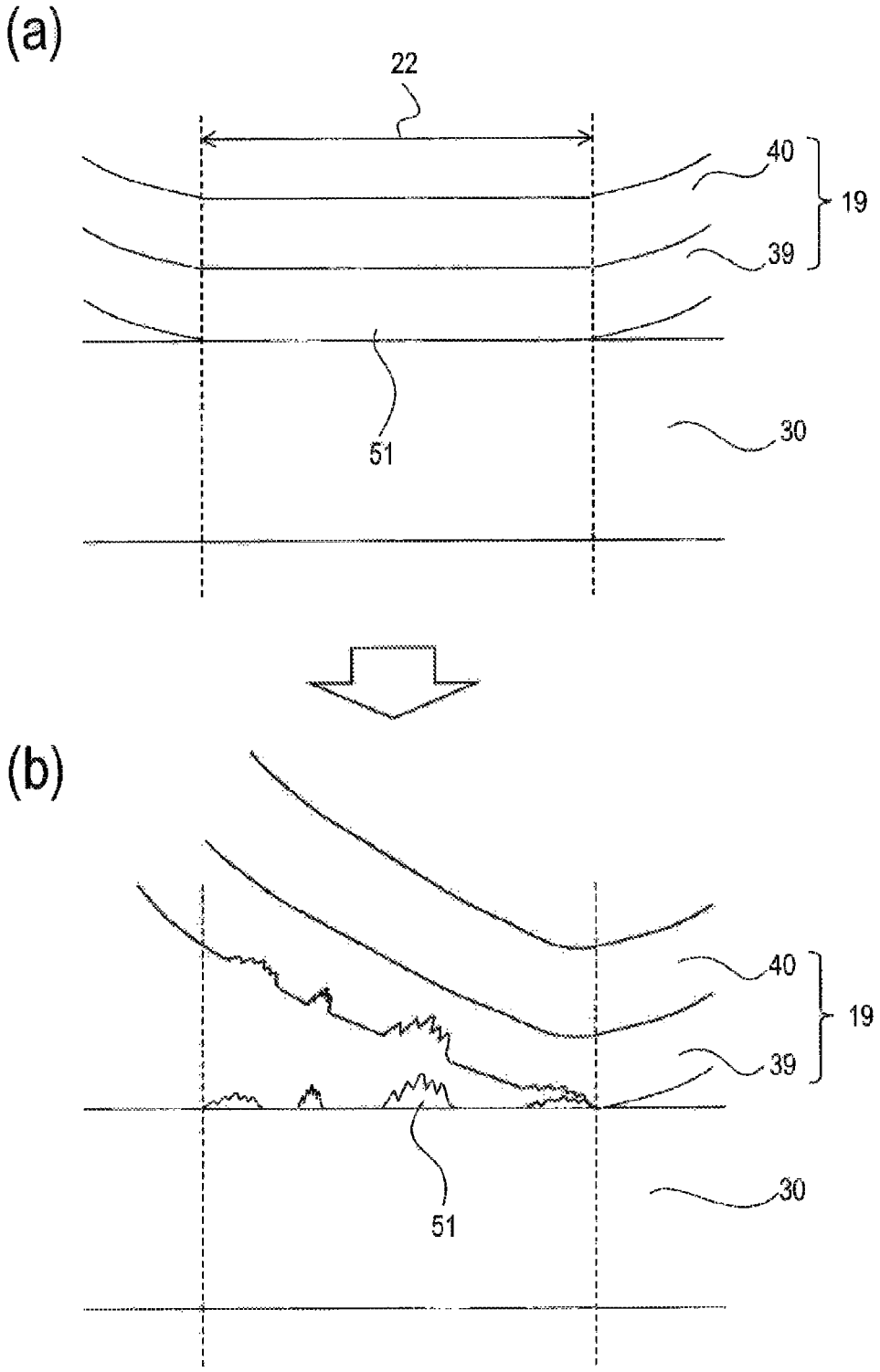

Parts (a) and (b) of FIG. 5 are principal sectional views or a sealing member in another comparison example.

Figure 6:
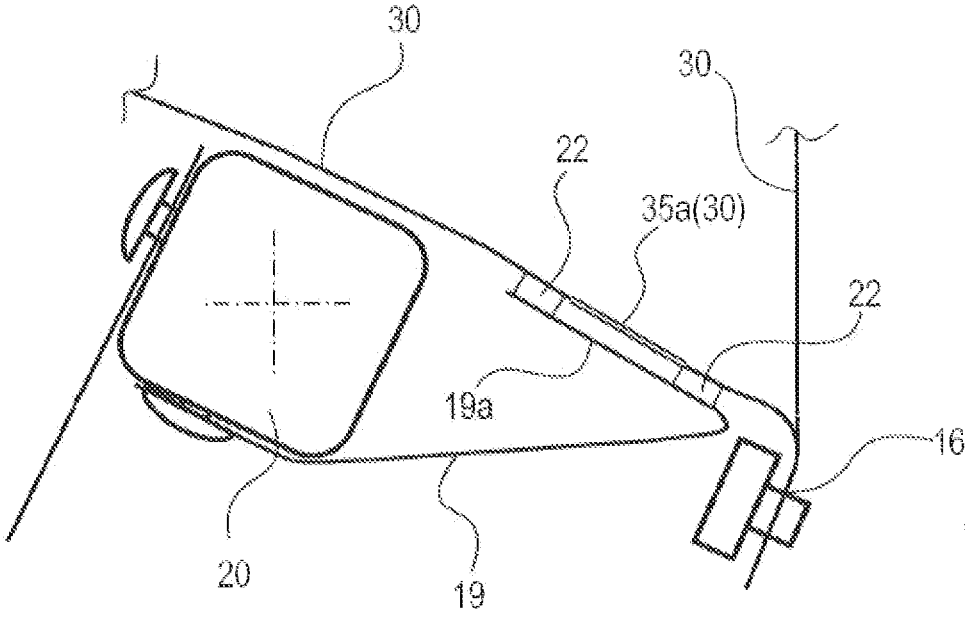

FIG. 6 is a schematic illustration of a developer accommodating unit in Embodiment 2 of the present invention.

Figure 7:
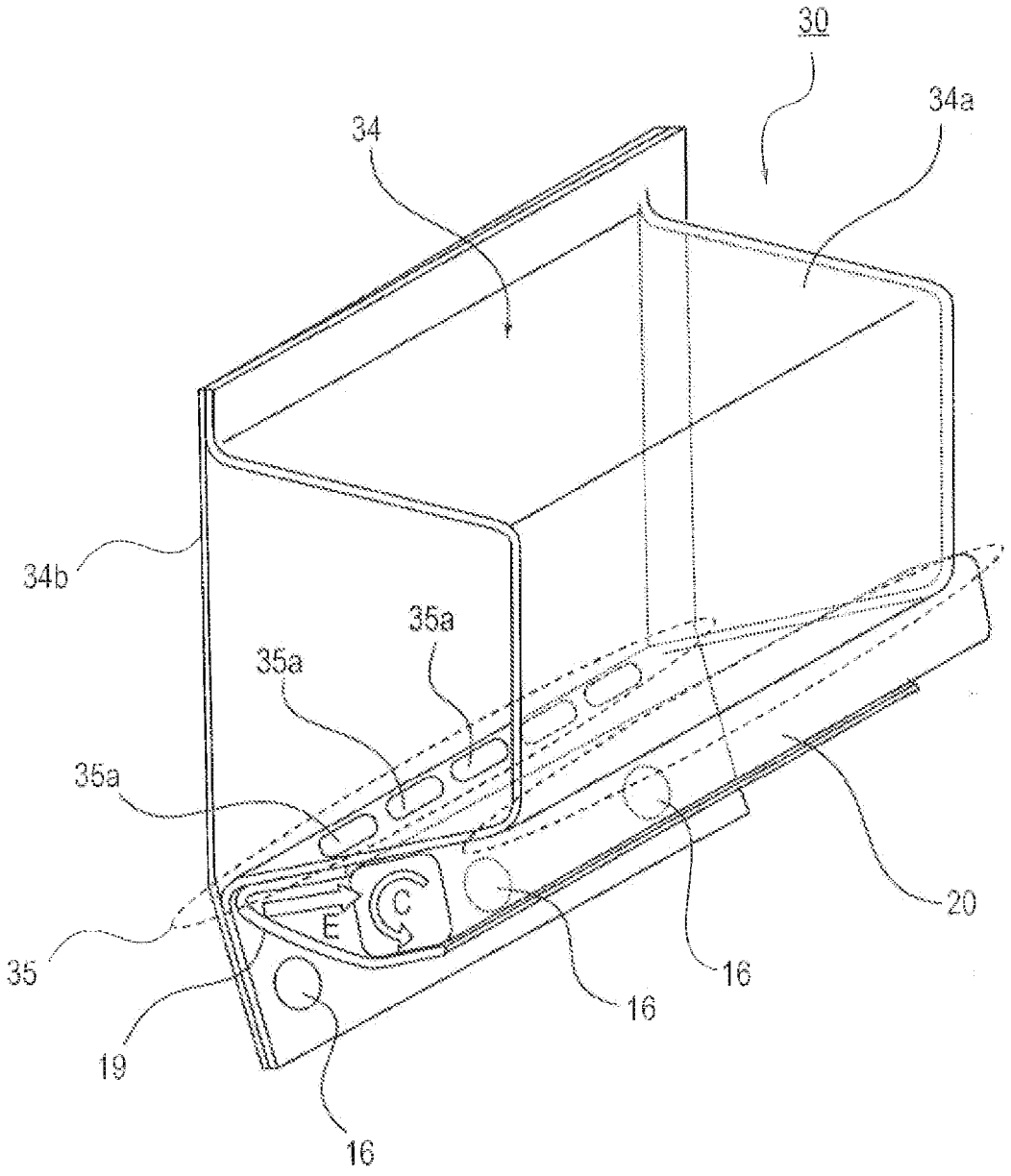

FIG. 7 is a schematic illustration of a developer accommodating container in Embodiment 2.

Figure 8:
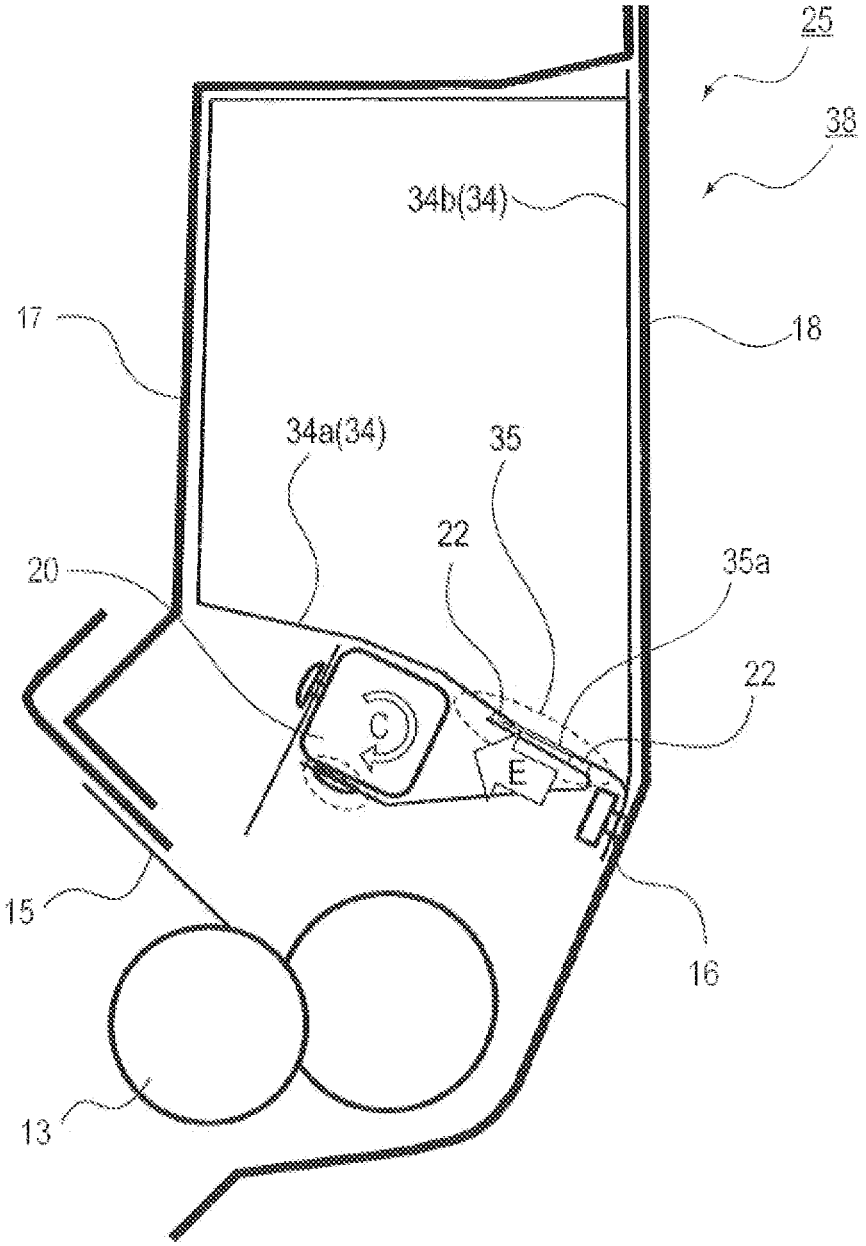

FIG. 8 is a schematic illustration of the developer accommodating unit in Embodiment 2.

Figure 9:
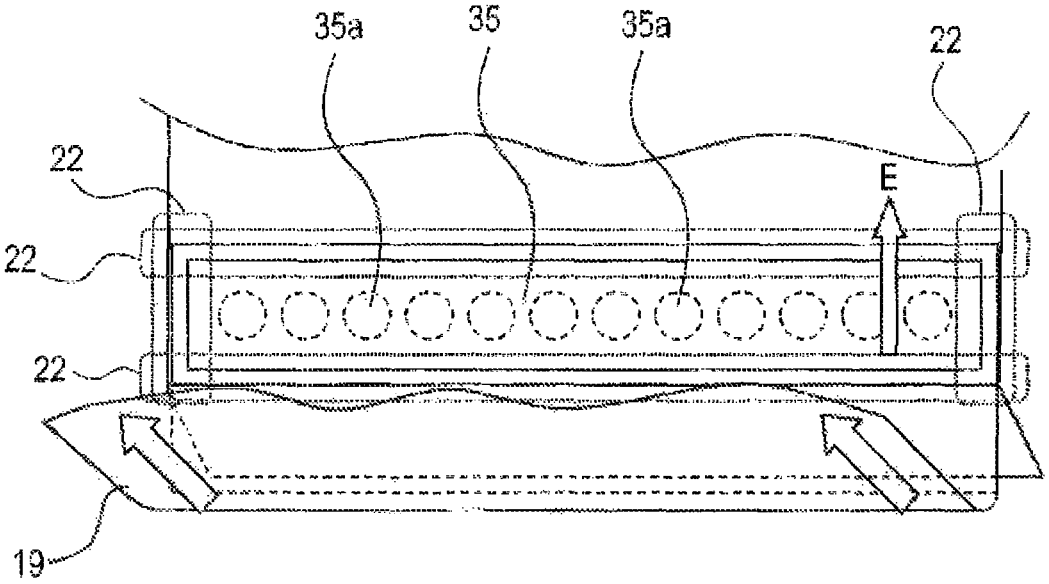

FIG. 9 is a schematic illustration of an arrangement method of a sealing member in Embodiment 2.

Figure 10:
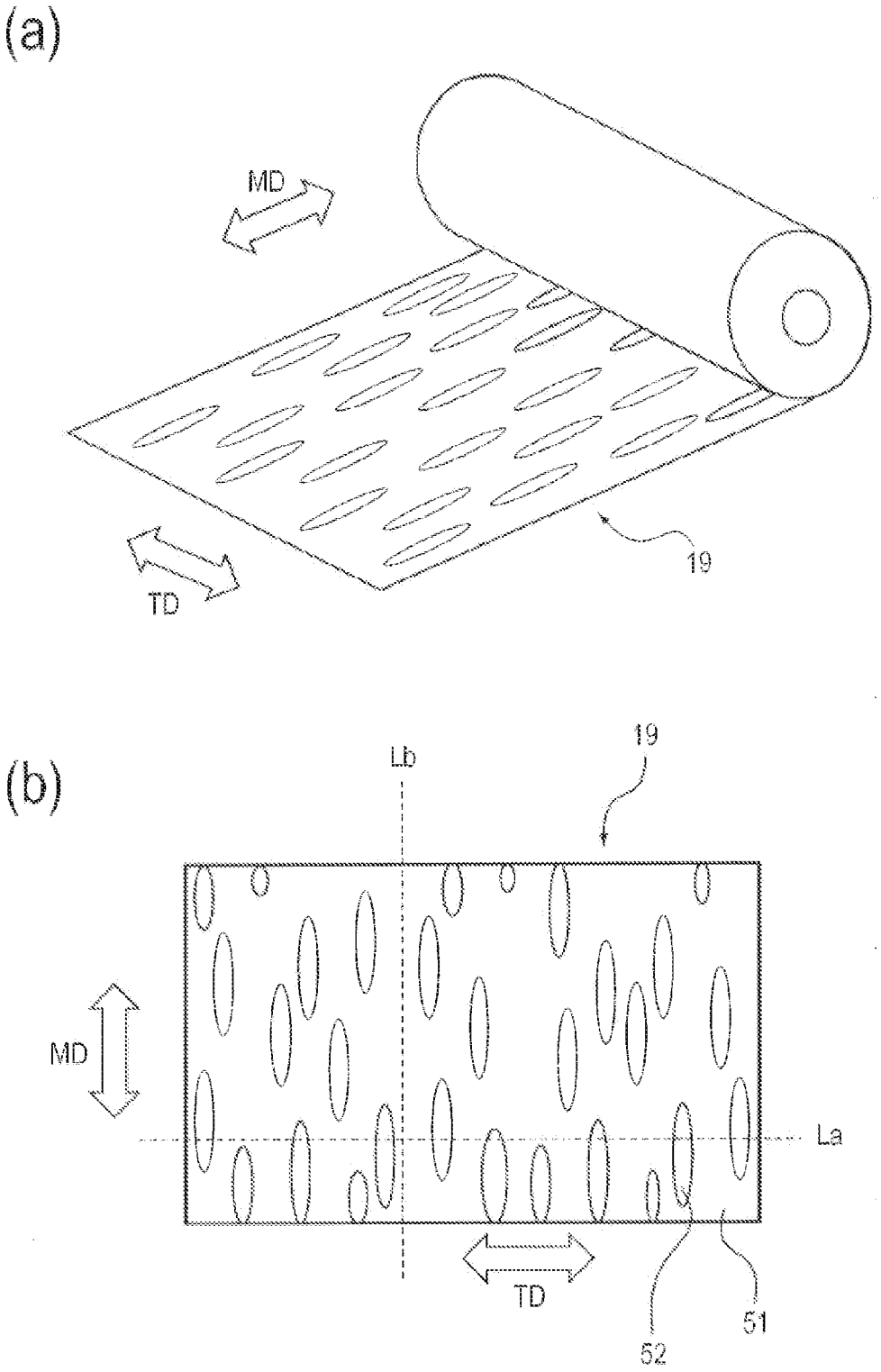

Parts (a) and (b) of FIG. 10 are schematic illustrations of the sealing member in Embodiment 2.

Figure 11:
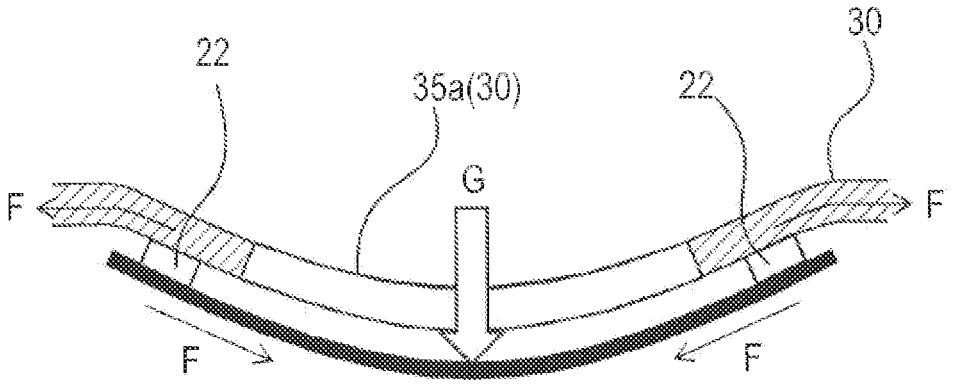

FIG. 11 is a schematic illustration of the sealing member in Embodiment 2.

Figure 12:
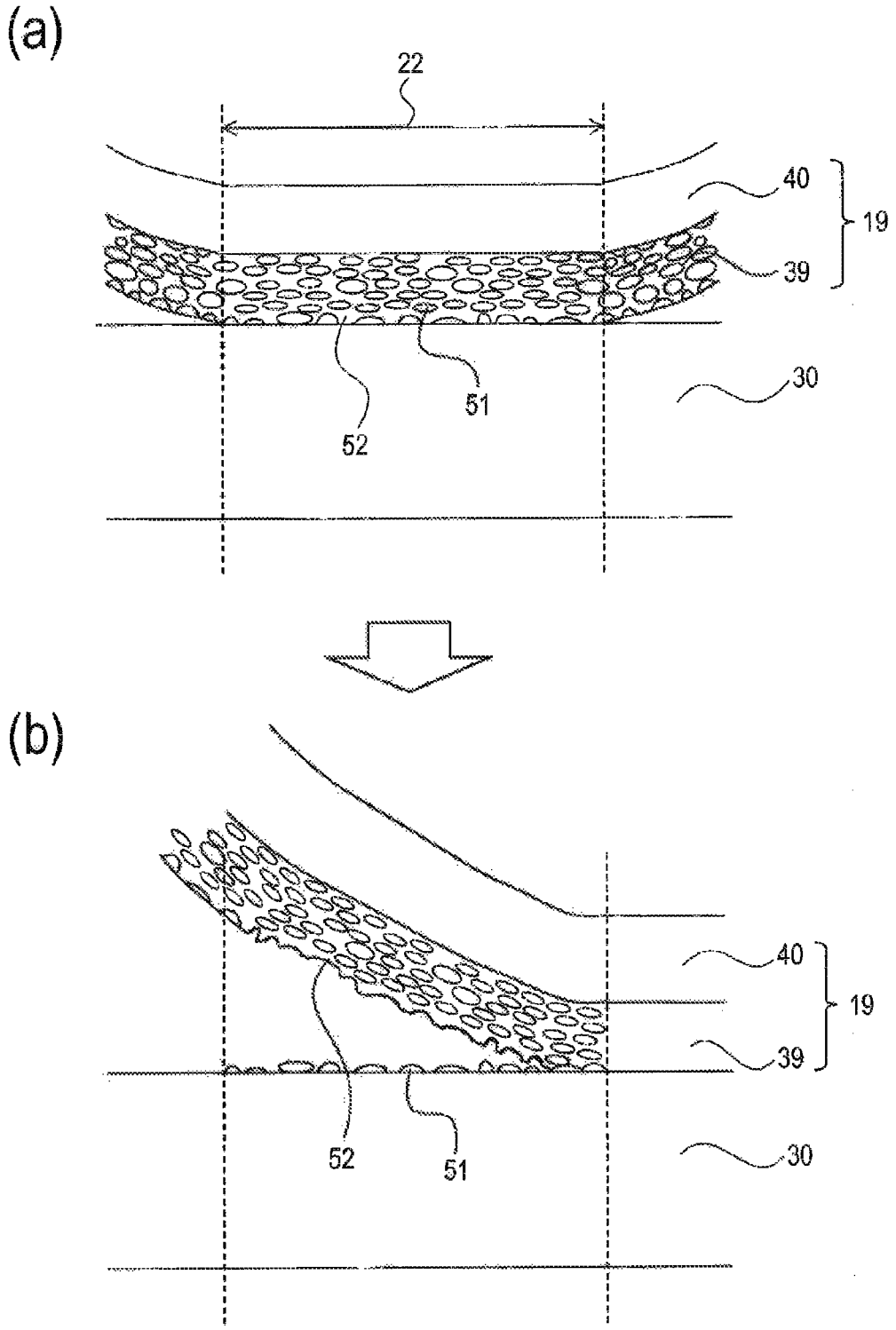

Parts (a) and (b) of FIG. 12 are principal sectional views of a sealing member in another embodiment of the present invention.

Figure 13:
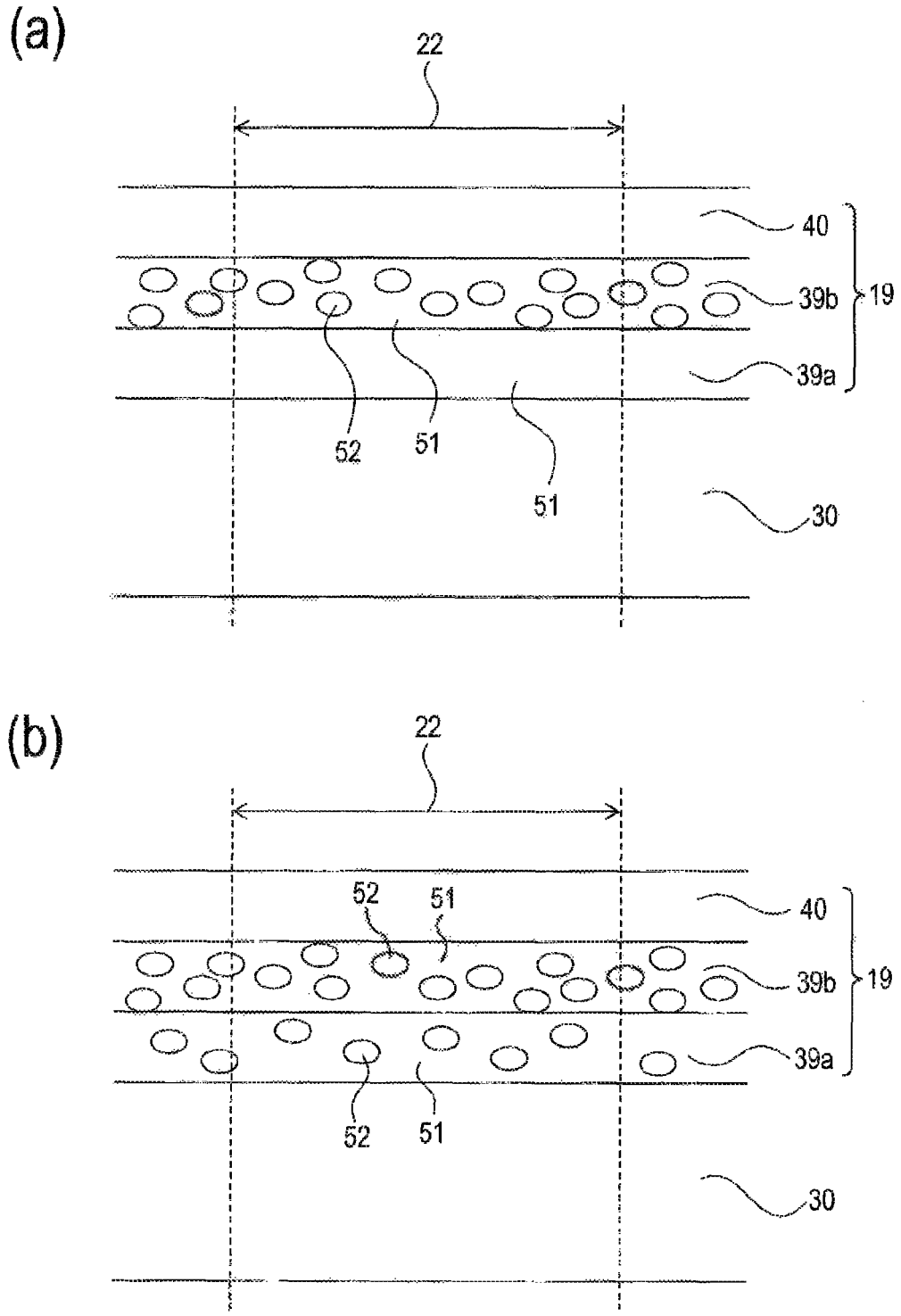

Parts (a) and (b) of FIG. 13 are principal sectional views each showing a sealing member in another embodiment of the present invention.

DESCRIPTION OF THE PREFERRED EMBODIMENTS

With reference to the drawings, preferred embodiments of the present invention will be exemplarily described specifically below. However, dimensions, materials, shapes and relative arrangements of constituent elements described in the following embodiments should be appropriately modified depending on constitutions and various conditions of an apparatus so which the present invention is applied, and therefore, tire scope of the present invention is not limited to the following embodiments, unless otherwise specified.

Incidentally, in one following description, a developer accommodating container; refers to a developer accommodating container as least includes a container for accommodating a developer and a sealing member, provided on the container, for scaling an opening for permitting discharge of the developer.

The developer accommodating container before accommodating the developer is referred to as a developer accommodating container 37 for accommodating the developer.

Embodiment 1

Figure 2:
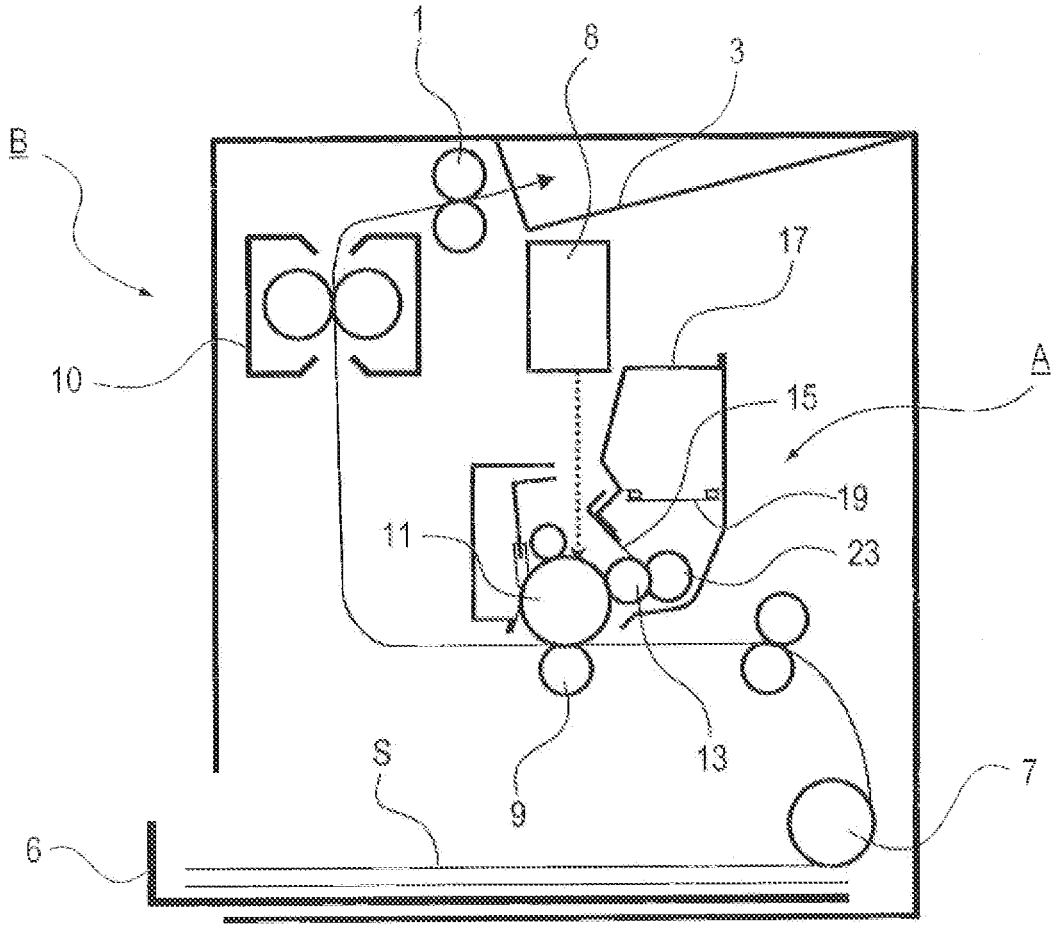
FIG. 2 is a principal sectional view of an image forming apparatus.

FIG. 1 is a principal sectional view of a process cartridge including a developer accommodating unit, and FIG. 2 is a principal sectional view of an image forming apparatus main assembly.

<Summary of Structure of Process Cartridges>

The process cartridge includes an image bearing member and process means actable on the image bearing member. Here, as the process means, there are, e.g., a charging means for electrically charging a surface of the image bearing member, a developing device for forming an image on the image bearing member, and a cleaning means for removing a developer (containing a toner, a carrier and the like) remaining on a surface of the image bearing member.

A process cartridge A in this embodiment includes, as shown in FIG. 1, includes an electrophotographic photosensitive drum 11 as an image bearing member and includes, at a periphery of the photosensitive drum 11, a charging roller 12 as a charging means and the cleaner unit 22 including an elastic cleaning blade 14 as a cleaning means. Further, the process cartridge A includes the developing device 38 including a first frame 17 and a second frame 18. The process cartridge A is prepared by integrally assembling the cleaner unit 21 and the developing device 38, and is constituted so as to be detachably mountable to an apparatus main assembly B of the electrophotographic image forming apparatus as shown in FIG. 2. The developing device 36 includes a developing roller 13 and a developing blade 15 which are used as a developing means, and a developer supplying roller 23. The developing roller 13 and the developing blade 15 are supported by the frame 17.

<Summary of Structure of Image Forming Apparatus>

A shown in FIG. 2, to the apparatus main assembly B of the electrophotographic image forming apparatus, the above-described process cartridge is detachably mounted and then is used for image formation. In a sheet cassette 6 mounted as a lower portion of the apparatus main assembly B, sheets S are accommodated. During the image formation, the sheet S accommodated in the sheet cassette 6 is fed by a feeding roller 7 toward an image forming portion. In synchronism with this feeding of the sheet S, the photosensitive drum 11 is subjected to selective exposure to light from an exposure device 8, so that a latent image is formed. The developer is supplied to the developing roller 13 (developer carrying member) by a sponge-like developer supplying roller 23, and then is carried in a thin layer on a surface of the developing roller 13 by the developing blade 15. By applying a developing bias (voltage) to the developing roller 13, the developer is supplied depending on the latent image, so that the latent image is developed into a developer image on the photosensitive drum 11. This developer image is transferred onto the conveyed sheet 3 by bias voltage application to a transfer roller 9. The sheet S on which the developer image is transferred is conveyed to a fixing device 10, in which the developer image is fixed on the sheet S, and then the sheet S is discharged onto a discharge portion 3 at an upper portion of the apparatus by a discharging roller 1.

<Summary of Structure of Developer Accommodating Unit>

Next, a structure are of a developer accommodating unit 25 will be described with reference to FIG. 1.

(Developer Accommodating Unit)

The developer accommodating unit 25 is, as shown in FIG. 1, constituted by the developing roller 13, the developing blade 15, and the first and second frames 17 and 18 for supporting these members. The first and second, frames 17 and 18 constitute in combination a frame for accommodating the developer.

Incidentally, in this embodiment, the developer accommodating unit 25 is the same as the developing device 38. This is because the developer accommodating unit 25 includes the developing roller 13 and the developing blade 15. However, the developing roller 13 and the developing blade 15 may also be supported by a frame other than the frame for the developer accommodating unit 25, thus being separated, from the developer accommodating unit 25. In this case, the developing device 38 is constituted by the developer accommodating unit 25, the developing roller 13 and the developing blade 15 (not shown).

<Structure of Sealing Member>

As shown in FIG. 1, a sealing member 19 covers, before use of the process cartridge A, a discharging port run 35 including openings 35*a* for permitting discharge of the developer, thus sealing the discharging portion 35*s* that the developer is prevented, from leaking out of the discharging portion 35. The sealing member 19 as moved, whereby the discharging portion 35 is exposed. The sealing member 19 has a sheet-like structure including a bonding portion 22 for covering the discharging portion 35. The sealing member 19 continuously surrounds a periphery of the discharging portion 35 at the bonding portion 22 and is bonded to the discharging portion 35 is an unsealable manner at the bonding portion 22, so that the developer accommodated in a developer accommodating container 30 is confined. This sheet-like sealing member 19 includes a sealant layer exhibiting an easy-unsealing property described later and is formed of a laminate material including a reinforcing layer. The reinforcing layer is formed of polyethylene terephthalate (PET), polyethylene, polypropylene, or the like, and its thickness may appropriately be selected from a range of 0.03-0.15 mm.

(Portion Having Easy-Unsealing Property of Sealing Member)

Next, a method in which a peeling force for peeling the sealing member 19 at the bonding portion 22 is set at a desired value will, be described. In this embodiment, in order to set the desired value (a force which is as small as possible within a range in which a toner sealing property can be maintained in this embodiment, the following method is employed.

As shown in FIG. 3, the sealing member 19 is formed of a laminate material including the sealant layer 39 enabling easy unsealing and including the reinforcing layer 40. The sealant layer 39 which is at least a part of the sealing member 19 is formed of a material 51 having compatibility with a material for the container 30 for accommodating the developer and a material 32 having incompatibility with the material for the container 30. Either one of the compatible material 51 and the incompatible material 52 is disposed in a state in which the material is dispersed in another material.

Here, as the compatible material 51 (the material having the compatibility), a combination of components formed of the same material is used. However, other than the combination, there is a combination of materials having the compatibility and therefore examples thereof are shown below. It is possible to use a combination of PS (including HIPS), which is a frame material and which is a non-crystalline material, with, as the material having the compatibility, ABS, PPO or the like which is the non-crystal, line material.

On the other hand, as the incompatible material 52 (the material having the incompatibility), it is possible to use PE, PP, PA, PET, POM or the like which are a crystalline material.

Further, in the case where the material for a molded portion 34*a* of a developer accommodating member 34 is PE which is the crystalline resin material, a material to be combined with the material (PE) is hard to be compatible with the material (PE) unless the material is the same material as the material (PE), and therefore as the material having the compatibility, only PE which is the same as the material (PE) is used. As the material having the incompatibility, it is possible to use PS, ABS, PP, PA, PET, POM and the like which are resin materials other than PE.

Further, as preferred materials described later for the molded portion 34*a* of the developer accommodating member 34, resin materials such as ABS, PMMA, PC, PP, PET and PVC will be described.

ABS which is the non-crystalline resin material has most excellent compatibility, and as the material having the compatibility, it is possible to use PS, AS, ABS, PMMA, PC, PVC and the like.

In the case of PMMA which is the non-crystalline material, as the material having the compatibility, it is possible to use PC, PVC and the like.

In the case of PC which is the non-crystalline material, as the material, having the compatibility, if is possible to use ABS, PMMA and the like.

In the case of PVC which is the non-crystalline material, as the material having the compatibility, it is possible to use PS, ABS, PMMA and the like.

In the cases of PP and PET, a material to be combined with these materials is hard to be compatible with these materials unless the material is the same as these materials, and therefore as the material having the compatibility, PP and PET are used for the materials (PP and PET), respectively.

Incidentally, as a material having an adhesive property, EVA is used. It is possible to effect welding of a combination of EVA and, e.g., PE, but this combination is not the combination or components having the same material. In this case, the welding is effected by using the adhesive property of EVA, and therefore EVA is the material having the incompatibility.

For example, in the case where the discharging portion 35 of the developer accommodating container 30 is formed of polystyrene (PS), in the sealant layer 39, polyethlene (PE) having the incompatibility is disposed in a state in which PE is three-dimensionally dispersed irregularity in PS which is the same material as the material for the discharging portion 35. Here, "three-dimensionally" refers to with respect to dimensions in three directions consisting of a peeling-off direction (unsealing direction) of the sealing member 19, a widthwise direction perpendicular to the peeling-off direction, and a thickness direction perpendicular to the peeling-off direction. In this way, easy unsealing of the sealing member 19 is enabled at the bonding portion 22.

Further, in the sealant layer 39 of the sealing member 19, a constitution in which an amount, of the incompatible material 52 is less than an amount of the compatible material 51 is employed. By this constitution, it is possible to mere stably improve compatibility between a sealing property and an unsealing property with respect to the sealing member 19.

Figure 4:
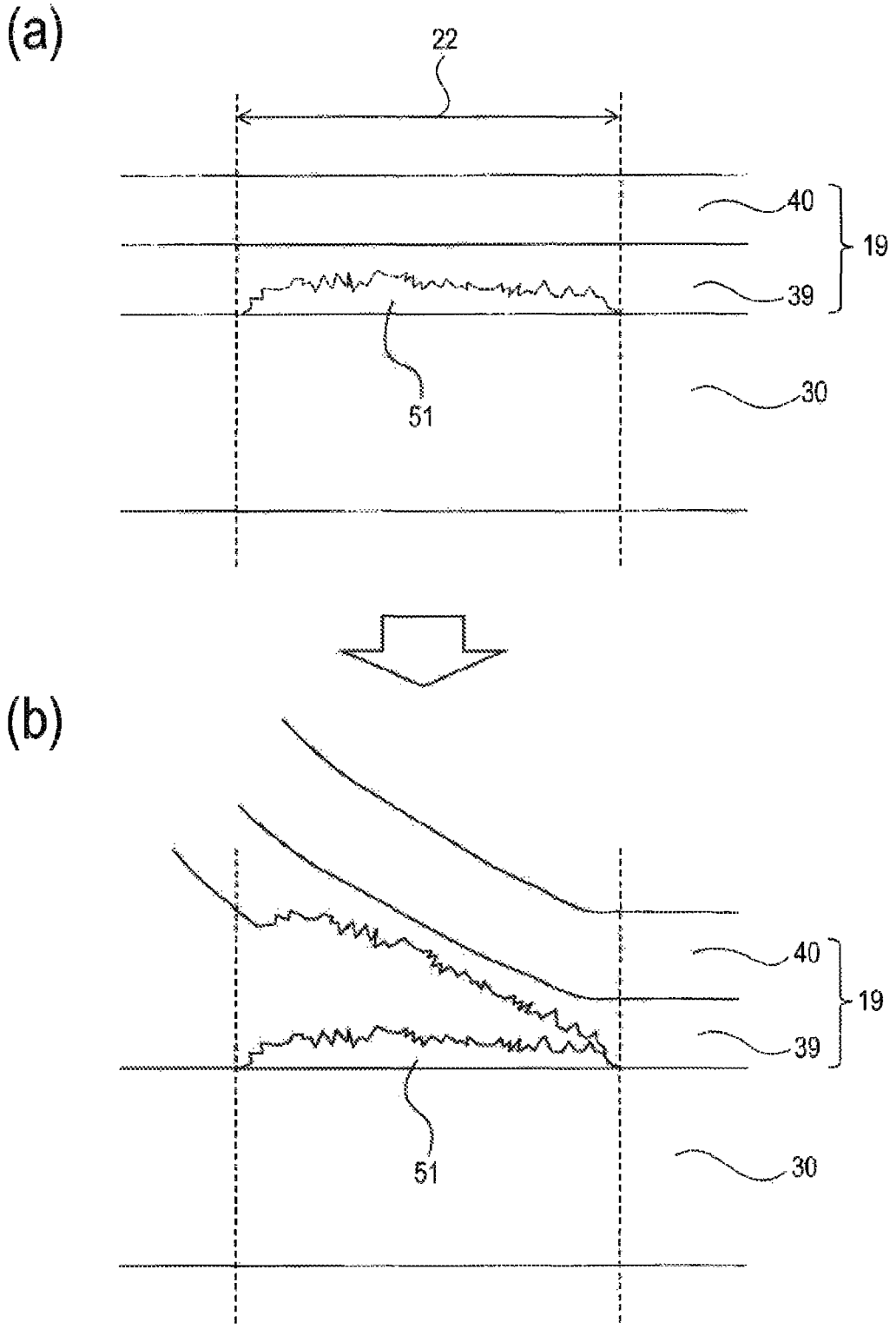

Here, a sealing member in a comparison example is shown in each of FIG. 4 and FIG. 5. A sealing member 19 shown in each of FIG. 4 and FIG. 5 is formed of a laminate material including a sealant layer 39 and a reinforcing layer 40. However, the sealant layer 39 is formed, of only the material 51 having the compatibility with the material for the container 30 for accommodating the developer. In the case of the sealing member 19 in the comparison example, as shown in (a) and (b) of FIG. 3, breakage of the material for the sealant layer 39 is generated in the entire region of the bonding portion of the sealing member 19 and therefore a strong peeling strength is required. Further, when a constitution in which peeling is made at a boundary between the sealant layer 39 and the developer accommodating container 30 as shown in (a) and (b) of FIG. 5 is employed, the peeling strength is changed under the influence of a surface state of the developer accommodating container 30 which is a welded surface. Therefore, the sealing property and the unsealing property became unstable.

Compared with the sealing members in these comparison examples, in the sealing member 19 in this embodiment (Embodiment 1), as shown in (a) and (b) of FIG. 3, the compatible material 51 and the incompatible material 52 dispersed in the compatible material 51 in the sealant layer 39 are not adhered to each other, and therefore almost no peeling strength is required. Correspondingly, it becomes possible to reduce a material breakage amount of the compatible material 51 at the bonding portion 22, so that it becomes possible to reduce a load when the sealing member 19 is peeled off. In addition, the sealant layer 39 and the developer accommodating container 30 are firmly welded to seal the sealing member 19 with reliability, so that the peeling is made in the sealant layer 39 and therefore it becomes possible to effect stable unsealing with no influence of the surface state of the developer accommodating container 30 as the welded surface. Moreover, it also becomes possible to control the peeling strength depending on an amount of the incompatible material 52 dispersed in the compatible material 51. In this way, according to this embodiment, by the above-described material constitution of the sealing member 10, the sealing property and the unsealing property can be stably improved while saving a space.

Embodiment 2

Summary of Structure of Developer Accommodating Unit

Next, a structure of the developer accommodating unit 25 will be described with reference to FIGS. 6, 7 and 8. FIG. 6 is a detailed sectional view of the developer accommodating member 34, as a flexible container, in the neighborhood of the discharging portion 35 for permitting discharge of the developer. FIG. 7 is a perspective view of the developer accommodating container 30. FIG. 8 is a sectional view of the developing device 38. Incidentally, in the sectional view, a cross section is a flat, plane passing through the unsealing member 20, the openings 35*a* and a fixing portion 16. Further, the cross section is a flat plane perpendicular to a rotation shaft (axis) of the unsealing member 20.

(Developer Accommodating Unit)

As shown in FIG. 8, the developer accommodating unit 25 is constituted by the developing roller 13, the developing blade 15, and the first and second frames 17 and 18 for supporting these members. The first and second frames 17 and 18 constitute in combination a frame for accommodating the developer accommodating container 30 shown in FIG. 7. As shown in FIG. 7, the developer accommodating container 30 is constituted by the developer accommodating member 34 and the sealing member 19 for sealing the openings 35*a* for permitting discharge of the developer and for exposing the openings 35*a* by being moved.

(Developer Accommodating Container Accommodating Developer)

As shown in FIG. 7, the developer accommodating container 30 is constituted by the developer, the developer accommodating member 34 and the sealing member 19. Here, the developer is powder.

With, respect to the developer accommodating member 34 of the developer accommodating container 30, as shown in FIGS. 6 and 7, the openings 35*a* of the discharging portion 35 for permitting discharge of the developer are sealed with the sealing member 19. In this way, the openings 35*a* of the developer accommodating container 30 which accommodates the developer are sealed and therefore the accommodated developer is not leaked out to the outside, so that the developer can be treated as a single unit.

(Structure of Developer Accommodating Member)

As shown in FIG. 7, the developer accommodating member 34 is constituted by the molded portion 34*a*, which is the flexible container formed by vacuum molding, air-pressure molding or press molding, and a sheet-like air-permeable portion 34*b*.

As a material for the molded portion 33*a*, materials such as ABS, PMMA, PC, PP, PE, HIPS, PET and PVC, and composite multi-layer materials of these materials may preferably be used. Further, a thickness of the molded portion 34*a* may preferably be about 0.1-1 mm in terms of a sheet-like material thickness before the molding. The material and thick the molded portion 34*a* may appropriately be selected depending on a cost, product specification, a manufacturing condition and the like.

Here, the discharging portion 35 (openings 35*a*) is provided at the molded portion 34*a*, and a direction in which unsealing of the developer accommodating member 34 advances is an unsealing direction E. Incidentally, the material constitution and the layer structure of the sealing member 19 are the same as those in Embodiment 1.

(Structure of Unsealing Member)

As shown in FIG. 6 and FIG. 7, the unsealing member 20 is engaged with the sealing member 19 at a free end portion of the sealing member 19 in a side with respect to the unsealing direction (arrow E direction is used for the purpose of peeling off the sealing member 19 from the developer accommodating container 30 by applying a force to the sealing member 19 to move the sealing member 19. In this embodiment, the unsealing member 20 has a rectangular shaft shape and is rotatably supported inside the frame at its ends, and on one surface of the rectangular shaft, the free end portion of the sealing member 19 is engaged.

The sealing member 19 may also be configured so as to automatically effect the unsealing by receiving a driving force from the apparatus main assembly B, Or, a user may grip and move the sealing member 19 to unseal the sealing member 19. In this embodiment, as described above, the unsealing member 20 is the rotation shaft provided in the frame, and when the unsealing member is rotated in an arrow C direction, the sealing member 19 engaged with the unsealing member 20 is pulled in the unsealing direction E to unseal the openings 35*a* of the developer accommodating container 30.

(Portion Having Easy-Unsealing Property of Sealing Member)

Next, an arrangement method of the sealing member 19 in which the peeling strength of the bonding portion 22 is set at a desired value will be described with reference to FIGS. 9 and 10.

Part (a) of FIG. 10 shows a roll-shaped sealing member 19 after the molding. This roll-shaped sealing member 19 is molded by kneading the compatible material 51 with the incompatible ma serial 52 and then by winding up the kneaded mixture while stretching the kneaded mixture in a thin layer. At this time, the compatible material 51 and the incompatible material 52 are stretched in a soft state, and therefore these materials are molded in a shape such that the materials are elongated in a stretching direction (MD) which is a direction in which the materials are stretched.

The sealing member 19 cut from the roll-shaped sealing member is moved in the unsealing direction (arrow E direction) to expose the openings 35*a*. The sealing member 19 is disposed so that the stretching direction (arrow MD direction) of the sealing member 19 shown in (a) of FIG. 10 is parallel to the unsealing direction E. As a result, the amount to of material breakage of the sealant layer generated per unit time during the unsealing becomes small, so that the peeling strength of the sealing member 19 is lowered.

The reason why the peeling strength of the sealing member 19 is lowered is as follows. The incompatible material 52 contained in the sealant layer 39 of the sealing member 19 is elongated in the stretching direction (arrow MD direction) as described above. For that reason, a time in which the incompatible material 52 is located on a peeling line La when the unsealing direction (arrow E direction in FIG. 9) of the sealing member 19 and the stretching direction (arrow MD direction in (b) of FIG. 10 are made parallel to each other is longer than that on a peeling line Lb in the case of a perpendicular direction (arrow TD direction). As a result, on the peeling line La, a proportion occupied by the incompatible material 52 located on the whole line is high, so that a proportion occupied by the compatible material 51 necessary to be subjected to material breakage becomes low. For this reason, by disposing (arranging) the sealing member 19 as described above, in addition to the effect of Embodiment 1, an effect such that the sealing member is further easily unsealed can be obtained. Incidentally, in this embodiment, the sealing member 19 having the peeling strength of about 3N/15 mm when the sealing member 19 is pulled in the unsealing direction E in testing methods for hermetically sealed flexible packages of JIS-Z0238 is used.

(Effect of Flexible Developer Accommodating Container)

An effect of disposing the sealing member 19 on the flexible developer accommodating container 30 will be described with reference to FIG. 11. When the developer accommodating container 3 is subjected to impact each as vibration during transportation, on the openings 35*a* of the discharging portion 35, a force with respect to a direction (arrow G direction) in which the sealing member 19 is to be peeled off by the developer is exerted. At this time, the discharging portion 35 has the flexibility and is deformed, and therefore a force exerted on the bonding portion 22 is directed in a shearing direction (arrow F direction), so that the sealing member 19 is hard to be peeled off when compared with a constitution in which the discharging portion 35 is not deformed. As a result, the sealing member 19 is capable of further stably realising compatibly the sealing property and the unsealing property.

Other Embodiments

In the above-described embodiments, as the state in which one of the compatible material 51 and the incompatible material 52 is dispersed in another material, the constitution in which the sealing member 19 includes the sealant layer 39 in which the incompatible material 52 is dispersed in the compatible material 51 is illustrated as an example, but an opposite constitution may also be employed. That is, as shown in (a) and (b) of FIG. 12, a constitution in which the sealing member 19 includes the sealant layer 39 in which the compatible material 51 is dispersed in the incompatible material 52 may also be employed. In this constitution, when the sealing member 19 is peeled, the sealing member 19 is peeled at an interface between the incompatible material 52 and the developer accommodating container 30, but the compatible material 51 is adhered to the developer accommodating container 30 ((b) of FIG. 12). For that reason, the sealing member 19 having the structure shown in FIG. 12 is different from the sealing members, shown in FIGS. 4 and 5, causing interfacial peeling, and similarly as in the sealing member 19 having the structure shown in FIG. 3, it is possible to control the peeling strength at a low level.

Further, in the above-described embodiments, the case where the sealant layer 39 as a part of the sealing member 19 is a single layer is illustrated as an example, but the sealant, layer 39 is not limited thereto. That is, a constitution in which, the sealant layer 39 as a part of the sealing member 19 includes a plurality of layers including a first layer to be bonded to the container 30 and a second layer adjacent to the first layer, and the second layer is formed of the compatible material 51 and the incompatible material 52 may also be employed. Specifically, e.g., as shown in (a) of FIG. 13, in the case where the sealant layer 39 includes two (first and second) layers 39*a* and 39*b*, a constitution in which the first layer 39*a* bonded to the container 30 is formed of only the compatible material 51 and the second layer 39*b* on the first layer 39*a* is formed of the compatible material 51 and the incompatible material 52, and on the second layer 39*b*, a reinforcing layer 40 is formed may also be employed. Further, as shown in (b) of FIG. 13, both of the first, layer 39*a* bonded to the container 30 and the second layer 39*b* on the first layer 39*a* are formed of the compatible material 51 and the incompatible material 52, and on the second layer 39*b*, the reinforcing layer 40 is formed may also be employed. Incidentally, in the structure shown in (b) of FIG. 13, a proportion of the incompatible material 52 in the second layer 39*b* is made higher than that in the first layer 39*a*. Thus, in the case where the sealant layer 39 as a part of the sealing member 19 includes the plurality of layers, in addition to the effect of Embodiment 1, the following effect can be obtained. That is, the sealing member 19 is stably peeled by the second layer, which is free from the influence of the bonding to the container, not by the first layer directly bonded co the container, and therefore the sealing property and the unsealing property can be further easily realised compatibly.

Further, in the above-described embodiments, as the process cartridge detachably mountable to the image forming apparatus main assembly, the process cartridge integrally including the photosensitive drum and, as the process means actable on the photosensitive drum, the charging means, the developing means and file cleaning means was illustrated as an example. However, the process cartridge is not limited thereto, but a process cartridge integrally including, in addition to the photosensitive dram, either one of the charging means, the developing means and the cleaning means may also be employed.

Further, in the above-described embodiments, the printer was illustrated as an example of the image forming apparatus, but the present invention is not limited thereto. For example, if is also possible to use another image forming apparatus such as a copying machine or a facsimile machine, and another image forming apparatus such as a multi-function machine having a combination of functions of these machines. By applying the present invention to the developer accommodating container, the developer accommodating unit or the process cartridge which are to be used in these image forming apparatuses, a similar effect can be obtained.

According to the present invention, by the material constitution of the sealing member, it is possible to stably improving compatibility of the sealing property and the unsealing property while saving the space.

While the invention has been described with reference to the structures disclosed herein, it is not confined to the details set forth and this application is intended to cover such modifications or changes as may come within the purpose of the improvements or the scope of the following claims.

This application claims priority from Japanese Patent applications Nos. 198056/2012 filed Sep. 10, 2012 and 160961/2013 filed Aug. 2, 2013, which are hereby incorporated by reference.

What is claimed is:

1. A developer accommodating container, provided with an opening for permitting discharge of a developer, for accommodating the developer, the developer accommodating container comprising:

a sealing member, capable of exposing the opening by being peeled in an unsealing direction, for sealing the opening, wherein the sealing member includes (i) a layer containing a material having compatibility with a material constituting the developer accommodating container, (ii) a plurality of dispersed portions, dispersed in the layer, each containing a material having incompatibility with the material constituting the developer accommodating container, and (iii) a bonding portion, extending in a longitudinal direction of the developer accommodating container, for being bonded to the developer accommodating container, wherein the dispersed portions have shapes such that the dispersed portions are stretched in the unsealing direction, and wherein the longitudinal direction and the unsealing direction cross each other.

2. The developer accommodating container according to claim 1, wherein the material constituting the developer accommodating container and the material having the compatibility are the same material.

3. The developer accommodating container according to claim 1, wherein the sealing member includes a first layer and a second layer adjacent to the first layer, and wherein the second layer contains the material having the compatibility and the material having the incompatibility.

4. The developer accommodating container according to claim 3, wherein the second layer is adjacent to the developer accommodating container and is fixed to the developer accommodating container.

5. The developer accommodating container according to claim 3, wherein the first layer is a reinforcing layer for reinforcing the second layer.

6. The developer accommodating container according to claim 3, wherein the material constituting the developer accommodating container and the material having the compatibility are welded to each other.

7. The developer accommodating container according to claim 1, wherein an amount of the material having the incompatibility in the sealing member is smaller than an amount of the material having the compatibility in the sealing member.

8. The developer accommodating container according to claim 1, further comprising an unsealing member for winding up the sealing member, wherein the unsealing member extends in a longitudinal direction of the developer accommodating container.

9. A developer accommodating unit for accommodating a developer, the developer accommodating unit comprising:

the developer accommodating container according to claim 1;

a frame for accommodating the developer accommodating container and for accommodating the developer to be discharged from the developer accommodating container; and an unsealing member, provided inside the frame, for peeling the sealing member sealing the opening of the developer accommodating container to expose the opening.

10. The developer accommodating unit according to claim 9, wherein the developer accommodating container includes a flexible container.

11. A developing device comprising:

a developer carrying member for carrying the developer; and the developer accommodating container according to claim 1.

12. A process cartridge comprising:

an image bearing member for bearing a developer image; and the developing device according to claim 11.

13. An image forming apparatus comprising:

the developer accommodating container according to claim 1, wherein an image is formed on a sheet with the developer.

14. A developer accommodating container, provided with an opening for permitting discharge of a developer, for accommodating the developer, the developer accommodating container comprising:

a sealing member, capable of exposing the opening by being peeled in an unsealing direction, for sealing the opening, wherein the sealing member includes (i) a layer containing a material having incompatibility with a material constituting the developer accommodating container, (ii) a plurality of dispersed portions, dispersed in the layer, each containing a material having compatibility with the material constituting the developer accommodating container, and (iii) a bonding portion, extending in a longitudinal direction of the developer accommodating container, for being bonded to the developer accommodating container, wherein the dispersed portions have shapes such that the dispersed portions are stretched in the unsealing direction, and wherein the longitudinal direction and the unsealing direction cross each other.

15. The developer accommodating container according to claim 14, wherein the material constituting the developer accommodating container and the material having the compatibility are the same material.

16. The developer accommodating container according to claim 14, wherein the sealing member includes a first layer and a second layer adjacent to the first layer, and wherein the second layer contains the material having the compatibility and the material having the incompatibility.

17. The developer accommodating container according to claim 16, wherein the second layer is adjacent to the developer accommodating container and is fixed to the developer accommodating container.

18. The developer accommodating container according to claim 16, wherein the first layer is a reinforcing layer for reinforcing the second layer.

19. The developer accommodating container according to claim 14, wherein the material constituting the developer accommodating container and the material having the compatibility are welded to each other.

20. The developer accommodating container according to claim 14, further comprising an unsealing member for winding up the sealing member, wherein the unsealing member extends in a longitudinal direction of the developer accommodating container.

21. A developer accommodating unit for accommodating a developer, the developer accommodating unit comprising:

the developer accommodating container according to claim 14;

a frame for accommodating the developer accommodating container and for accommodating the developer to be discharged from the developer accommodating container; and an unsealing member, provided inside the frame, for peeling the sealing member sealing the opening of the developer accommodating container to expose the opening.

22. The developer accommodating unit according to claim 21, wherein the developer accommodating container includes a flexible container.

23. A developing device comprising:

a developer carrying member for carrying the developer; and the developer accommodating container according to claim 12.

24. A process cartridge comprising:

an image bearing member for bearing a developer image; and the developing device according to claim 23.

25. An image forming apparatus comprising:

the developer accommodating container according to claim 14, wherein an image is formed on a sheet with the developer.

26. A developer accommodating unit comprising:

a frame, provided with an opening for permitting discharge of a developer, for accommodating the developer;

a sealing member, capable of exposing the opening by being peeled in an unsealing direction, for sealing the opening, wherein the sealing member includes (i) a layer containing a material having compatibility with a material constituting the frame, (ii) a plurality of dispersed portions, dispersed in the layer, each containing a material having incompatibility with the material constituting the frame, and (iii) a bonding portion, extending in a longitudinal direction of the frame, for being bonded to the frame, wherein the dispersed portions have shapes such that the dispersed portions are stretched in the unsealing direction, and wherein the longitudinal direction and the unsealing direction cross each other.

27. The developer accommodating unit according to claim 26, wherein the material constituting the frame and the material having the compatibility are the same material.

28. The developer accommodating unit according to claim 26, wherein the sealing member includes a first layer and a second layer adjacent to the first layer, and wherein the second layer contains the material having the compatibility and the material having the incompatibility.

29. The developer accommodating unit according to claim 28, wherein the second layer is adjacent to the frame and is fixed to the fame.

30. The developer accommodating unit according to claim 28, wherein the first layer is a reinforcing layer for reinforcing the second layer.

31. The developer accommodating unit according to claim 26, wherein the material constituting the frame and the material having the compatibility are welded to each other.

32. The developer accommodating unit according to claim 26, wherein an amount of the material having the incompatibility in the sealing member is smaller than an amount of the material having the compatibility in the sealing member.

33. The developer accommodating unit according to claim 26, further comprising an unsealing member for winding up the sealing member, wherein the unsealing member extends in a longitudinal direction of the frame.

34. The developer accommodating unit according to claim 33, wherein the unsealing member is provided in the developer accommodating unit.

35. A developing device comprising:

a developer carrying member for carrying the developer; and the developer accommodating unit according to claim 26.

36. A process cartridge comprising:

an image bearing member for bearing a developer image; and the developing device according to claim 35.

37. An image forming apparatus comprising:

the developer accommodating unit according to claim 26, wherein an image is formed on a sheet with the developer.

38. A developer accommodating unit comprising:

a frame, provided with an opening for permitting discharge of a developer, for accommodating the developer;

a sealing member, capable of exposing the opening by being peeled in an unsealing direction, for sealing the opening, wherein the sealing member includes (i) a layer containing a material having incompatibility with a material constituting the frame (ii) a plurality of dispersed portions, dispersed in the layer, each containing a material having compatibility with the material constituting the frame, and (iii) a bonding portion, extending in a longitudinal direction of the frame, for being bonded to the frame, wherein the dispersed portions have shapes such that the dispersed portions are stretched in the unsealing direction, and wherein the longitudinal direction and the unsealing direction cross each other.

39. The developer accommodating unit according to claim 38, wherein the material constituting the frame and the material having the compatibility are the same material.

40. The developer accommodating unit according to claim 38, wherein the sealing member includes a first layer and a second layer adjacent to the first layer, and wherein the second layer contains the material having the compatibility and the material having the incompatibility.

41. The developer accommodating unit according to claim 40, wherein the second layer is adjacent to the frame and is fixed to the frame.

42. The developer accommodating unit according to claim 40, wherein the first layer is a reinforcing layer for reinforcing the second layer.

43. The developer accommodating unit according to claim 38, wherein the material constituting the frame and the material having the compatibility are welded to each other.

44. The developer accommodating unit according to claim 38, further comprising an unsealing member for winding up the sealing member, wherein the unsealing member extends in a longitudinal direction of the frame.

45. The developer accommodating unit according to claim 44, wherein the unsealing member is provided in the developer accommodating unit.

46. A developing device comprising:

a developer carrying member for carrying the developer; and the developer accommodating unit according to claim 38.

47. A process cartridge comprising:

an image bearing member for bearing a developer image; and the developing device according to claim 46.

48. An image forming apparatus comprising:

the developer accommodating unit according to claim 38, wherein an image is formed on a sheet with the developer.

* * * * *